US008464567B2

(12) United States Patent
Saville

(10) Patent No.: US 8,464,567 B2
(45) Date of Patent: Jun. 18, 2013

(54) DISTRIBUTED DRIVES FOR A MULTI-STAGE CAN NECKING MACHINE

(75) Inventor: Benjamin Lee Saville, West Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 749 days.

(21) Appl. No.: 12/109,058

(22) Filed: Apr. 24, 2008

(65) Prior Publication Data

US 2009/0266130 A1 Oct. 29, 2009

(51) Int. Cl.
*B21D 51/26* (2006.01)

(52) U.S. Cl.
USPC ..... 72/94; 72/405.03; 72/443; 72/449

(58) Field of Classification Search
USPC ..... 72/94, 405.03, 443, 449, 41, 43, 72/249; 74/813 R, 825; 198/575, 577, 579, 198/583, 608
See application file for complete search history.

(56) References Cited

U.S. PATENT DOCUMENTS

| | | | |
|---|---|---|---|
| 137,400 | A | 4/1873 | Ahrend |
| 548,888 | A | 10/1895 | Noteman |
| 593,755 | A | 11/1897 | Pond et al. |
| 1,459,584 | A | 6/1923 | Ericsson |
| 1,498,940 | A | 6/1924 | Wheeler |
| 1,621,301 | A | 3/1927 | Wright |
| 2,467,278 | A | 4/1949 | Thompson |
| 2,550,156 | A | 4/1951 | Lyon |
| 2,686,551 | A | 8/1954 | Laxo |
| 2,874,562 | A | 2/1959 | Cross |
| 2,928,454 | A | 3/1960 | Laxo |
| 2,940,502 | A | 6/1960 | La |
| 3,096,709 | A | 7/1963 | Eldred et al. |
| 3,143,366 | A | 8/1964 | Nichols |
| 3,268,054 | A | 8/1966 | Murphy et al. |
| 3,344,685 | A | 10/1967 | Crouzet |
| 3,374,684 | A | 3/1968 | Greven |

(Continued)

FOREIGN PATENT DOCUMENTS

| | | |
|---|---|---|
| CA | 2536841 | 2/2006 |
| DE | 19 39 623 A1 | 2/1970 |

(Continued)

OTHER PUBLICATIONS

U.S. Appl. No. 11/643,935, filed Dec. 22, 2006, Shortridge et al.

(Continued)

*Primary Examiner* — Edward Tolan
(74) *Attorney, Agent, or Firm* — Woodcock Washburn LLP

(57) ABSTRACT

A multi-stage can necking machine having distributed drives is provided. The multi-stage can necking machine may include a plural of operation stages, wherein at least some of the operation stages may be configured for can necking operations. Each operation stage may include a main turret shaft, a transfer starwheel shaft, and a support for mounting the main turret shaft and transfer starwheel shaft. Each main turret shaft and transfer starwheel shaft may have a gear, and the gears of the operation stages may be in meshed communication to form a continuous gear train. A plural of motors may be distributed among the operation stages and mechanically coupled to the gear train, wherein each one of the motors may be capable of transmitting power to the gear train.

16 Claims, 7 Drawing Sheets

U.S. PATENT DOCUMENTS

| | | | | |
|---|---|---|---|---|
| 3,406,648 | A | | 10/1968 | David |
| 3,418,837 | A | | 12/1968 | van der Laan et al. |
| 3,599,780 | A | | 8/1971 | Sorbie |
| 3,621,530 | A | | 11/1971 | Pflieger et al. |
| 3,635,069 | A | | 1/1972 | Eickenhorst |
| 3,659,443 | A | | 5/1972 | Ball |
| 3,687,098 | A | | 8/1972 | Maytag |
| 3,797,429 | A | | 3/1974 | Wolfe |
| 3,983,729 | A | | 10/1976 | Traczyk et al. |
| 4,030,432 | A | | 6/1977 | Miller et al. |
| 4,164,997 | A | | 8/1979 | Mueller |
| 4,224,818 | A | * | 9/1980 | Jones et al. ..... 72/284 |
| 4,341,103 | A | | 7/1982 | Escallon et al. |
| 4,457,160 | A | | 7/1984 | Wünsch |
| 4,462,467 | A | * | 7/1984 | Weingartner ..... 173/105 |
| 4,513,595 | A | | 4/1985 | Cvacho |
| 4,514,071 | A | * | 4/1985 | Koninger et al. ..... 396/617 |
| 4,519,232 | A | | 5/1985 | Traczyk et al. |
| 4,576,024 | A | | 3/1986 | Weber |
| 4,584,903 | A | * | 4/1986 | Hirt et al. ..... 74/665 M |
| 4,590,788 | A | | 5/1986 | Wallis |
| 4,624,098 | A | | 11/1986 | Trendel |
| 4,671,093 | A | | 6/1987 | Dominico et al. |
| 4,693,108 | A | | 9/1987 | Traczyk et al. |
| 4,732,027 | A | | 3/1988 | Traczyk et al. |
| 4,773,250 | A | | 9/1988 | Miyazaki |
| 4,817,409 | A | | 4/1989 | Bauermeister |
| 4,838,064 | A | | 6/1989 | Paess |
| 4,892,184 | A | | 1/1990 | Vander Griendt et al. |
| 4,945,954 | A | | 8/1990 | Wehrly et al. |
| 5,105,649 | A | | 4/1992 | Hite et al. |
| 5,209,101 | A | | 5/1993 | Finzer |
| 5,226,303 | A | | 7/1993 | Dieden et al. |
| 5,235,839 | A | | 8/1993 | Lee, Jr. et al. |
| 5,245,848 | A | | 9/1993 | Lee, Jr. et al. |
| 5,282,375 | A | | 2/1994 | Lee, Jr. et al. |
| 5,349,836 | A | | 9/1994 | Lee, Jr. |
| 5,353,619 | A | | 10/1994 | Chu et al. |
| 5,370,472 | A | | 12/1994 | Muellenberg |
| 5,398,603 | A | * | 3/1995 | Hartmann et al. ..... 101/183 |
| 5,467,628 | A | | 11/1995 | Bowlin et al. |
| 5,469,729 | A | | 11/1995 | Hager |
| 5,540,320 | A | | 7/1996 | Sarto et al. |
| 5,553,826 | A | | 9/1996 | Schultz |
| 5,611,231 | A | | 3/1997 | Marritt et al. |
| 5,634,364 | A | | 6/1997 | Gardner et al. |
| 5,676,006 | A | | 10/1997 | Marshall |
| 5,713,235 | A | | 2/1998 | Diekhoff |
| 5,724,848 | A | | 3/1998 | Aschberger |
| 5,755,130 | A | | 5/1998 | Tung et al. |
| 5,761,945 | A | * | 6/1998 | Vandenbroucke ..... 72/176 |
| 5,782,308 | A | | 7/1998 | Latten et al. |
| 5,882,178 | A | | 3/1999 | Hudson et al. |
| 5,906,120 | A | | 5/1999 | Thacker et al. |
| 6,032,502 | A | | 3/2000 | Halasz et al. |
| 6,055,836 | A | | 5/2000 | Waterworth et al. |
| 6,085,563 | A | | 7/2000 | Heiberger et al. |
| 6,094,961 | A | | 8/2000 | Aschberger |
| 6,134,930 | A | * | 10/2000 | Shore et al. ..... 72/43 |
| 6,164,109 | A | | 12/2000 | Bartosch |
| 6,167,743 | B1 | | 1/2001 | Marritt et al. |
| 6,176,006 | B1 | | 1/2001 | Milliman et al. |
| 6,178,797 | B1 | | 1/2001 | Marshall et al. |
| 6,199,420 | B1 | | 3/2001 | Bartosch |
| 6,205,926 | B1 | * | 3/2001 | Dufour ..... 101/492 |
| 6,240,760 | B1 | | 6/2001 | Heiberger et al. |
| 6,571,986 | B1 | | 6/2003 | Simmons |
| 6,644,083 | B2 | | 11/2003 | Pakker |
| 6,658,913 | B1 | | 12/2003 | Zanzerl et al. |
| 6,661,020 | B2 | | 12/2003 | Schill et al. |
| 6,672,122 | B2 | | 1/2004 | Mustread et al. |
| 6,698,265 | B1 | | 3/2004 | Thomas |
| 6,725,780 | B2 | * | 4/2004 | Berti et al. ..... 101/484 |
| 6,752,000 | B2 | | 6/2004 | Reynolds et al. |
| 6,779,651 | B1 | | 8/2004 | Linglet et al. |
| 6,827,018 | B1 | * | 12/2004 | Hartmann et al. ..... 101/485 |
| 6,911,752 | B1 | * | 6/2005 | Breit et al. ..... 310/87 |
| 7,028,857 | B2 | | 4/2006 | Peronek |
| 7,069,765 | B2 | | 7/2006 | Grove et al. |
| 7,100,417 | B2 | | 9/2006 | Yamanaka et al. |
| 7,341,077 | B2 | * | 3/2008 | Sampers ..... 139/55.1 |
| 7,404,309 | B2 | * | 7/2008 | Schill et al. ..... 72/405.03 |
| 2002/0029599 | A1 | | 3/2002 | Heiberger |
| 2002/0148266 | A1 | | 10/2002 | Heiberger et al. |
| 2004/0050668 | A1 | | 3/2004 | Bowlin et al. |
| 2004/0069027 | A1 | | 4/2004 | Fukushima |
| 2005/0193796 | A1 | | 9/2005 | Heiberger et al. |
| 2006/0101884 | A1 | | 5/2006 | Schill et al. |
| 2006/0101885 | A1 | | 5/2006 | Schill et al. |
| 2006/0101889 | A1 | | 5/2006 | Schill et al. |
| 2006/0104745 | A1 | | 5/2006 | Schill et al. |
| 2007/0227218 | A1 | | 10/2007 | Shortridge |
| 2007/0227320 | A1 | | 10/2007 | Marshall |
| 2007/0227859 | A1 | | 10/2007 | Marshall et al. |
| 2007/0249424 | A1 | | 10/2007 | Marshall et al. |
| 2007/0251803 | A1 | | 11/2007 | Schill et al. |
| 2007/0283544 | A1 | | 12/2007 | Schill et al. |
| 2007/0283665 | A1 | | 12/2007 | Schill et al. |

FOREIGN PATENT DOCUMENTS

| | | | | |
|---|---|---|---|---|
| DE | 101 56 085 | A1 | | 5/2003 |
| EP | 0 885 076 | | | 7/2002 |
| FR | 2 881 123 | A1 | | 7/2006 |
| GB | 189707306 | | | 3/1898 |
| GB | 2173437 | A | | 10/1986 |
| JP | 2001-18328 | | * | 1/2001 |
| JP | 2002 102968 | | | 4/2002 |
| JP | 2003-237752 | | | 8/2003 |
| JP | 2003 251424 | | | 9/2003 |
| JP | 2003-252321 | | | 9/2003 |
| JP | 2003320432 | | | 11/2003 |
| JP | 2004-002557 | | | 1/2004 |
| JP | 2004-130386 | | | 4/2004 |
| JP | 2004160468 | | | 6/2004 |
| JP | 2004-217305 | | | 8/2004 |
| JP | 2005-022663 | | | 1/2005 |
| JP | 2006-176140 | | | 7/2006 |
| JP | 2006-176183 | | | 7/2006 |
| WO | WO 94/12412 | | | 6/1994 |
| WO | WO 97/37786 | A1 | | 10/1997 |
| WO | WO 97/49509 | | | 12/1997 |
| WO | WO 00/23212 | A | | 4/2000 |
| WO | WO 2006/055185 | A | | 5/2006 |
| WO | WO 2006/067207 | | | 6/2006 |
| WO | WO 2006/067901 | | | 6/2006 |

OTHER PUBLICATIONS

Intech Corporation, "Intech Power-Core™ Non-Lubricated Gears Replace Metal Gears in Belvac Neckers Model 595, 795, Modular, etc.", Necker Gears, http://www.intechpower.com/products/intech-can-making-machinery/necker-gears/, © 2011, accessed Sep. 23, 2011, 2 pages.

* cited by examiner

DISTRIBUTED DRIVES FOR A MULTI-STAGE CAN NECKING MACHINE

CROSS REFERENCE TO RELATED APPLICATIONS

This application is related by subject matter to the inventions disclosed in the following commonly assigned applications: U.S. patent application Ser. No. 12/109,031 filed on Apr. 24, 2008 and entitled "Apparatus For Rotating A Container Body", U.S. patent application Ser. No. 12/108,950 filed on Apr. 24, 2008 and entitled "Adjustable Transfer Assembly For Container Manufacturing Process", U.S. patent application Ser. No. 12/108,926 filed on Apr. 24, 2008 and entitled "Container Manufacturing Process Having Front-End Winder Assembly", U.S. patent application Ser. No. 12/109,131 filed on Apr. 24, 2008 and entitled "Systems And Methods For Monitoring And Controlling A Can Necking Process" and U.S. patent application Ser. No. 12/109,176 filed on Apr. 24, 2008 and entitled "High Speed Necking Configuration." The disclosure of each application is incorporated by reference herein in its entirety.

FIELD OF THE TECHNOLOGY

The present technology relates to a manufacturing machine having distributed drives. More particularly, the present technology relates to a multi-stage can necking machine having distributed drives.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been the conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2^{11}/_{16}{}^{th}$ inches to $2^{6}/_{16}{}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer starwheel shaft that carries a starwheel to transfer cans between turret starwheels.

The starwheel shafts and the main turret shafts each include a gear, wherein the gears of each shaft are in meshed communication to form a continuous gear train. In conventional can necking systems, a single motor is used to provide the torque required to drive the entire gear train at high speeds. In some circumstances, such as when personnel safety is implicated, an emergency requires rapid stopping of the turrets. An emergency stop put a high torque load on the gear teeth compared with normal operation. Start up conditions may also create relatively high torque load on some gear teeth.

There is a general need for improved driving configurations for necking machines.

SUMMARY

A multi-stage can necking machine may have distributed drives. Such a multi-stage can necking machine may include a plural of operation stages, wherein at least some of the operation stages may be configured for can necking operations. Each operation stage may include a main turret shaft, a transfer starwheel shaft, and a support for mounting the main turret shaft and transfer starwheel shaft. Each main turret shaft and transfer starwheel shaft may have a gear, and the gears of the operation stages may be in meshed communication to form a continuous gear train. A plural of motors may be distributed among the operation stages and mechanically coupled to the gear train, wherein each one of the motors may be capable of transmitting power to the gear train.

In some embodiments, the multi-stage can necking machine may not require an oil bath for the gears that drive the shafts to properly operate. For example, the multi-stage can necking machine may have some gears made of a composite material. Because the gears are made of a composite material, and not steel, they do not have to operate within an oil bath. Furthermore, certain composites may be used that expand when they heat up to thereby help reduce backlash between adjacent gears.

In some embodiments, the multi-stage can necking machine may be configured to provide easy access to the gears. For example, the multi-stage can necking machine may be configured such that each shaft may extend through a respective support so that the gears may be exterior to the supports.

DETAILED DESCRIPTION OF ILLUSTRATIVE EMBODIMENTS

A preferred configuration for driving a multi-stage can necking machine is provided. The multi-stage can necking machine incorporates technology that overcomes the many shortcomings of known multi-stage can necking machines. The present invention is not limited to the disclosed configuration, but rather encompasses use of the technology disclosed, in any manufacturing application according to the language of the claims.

Figure 1:
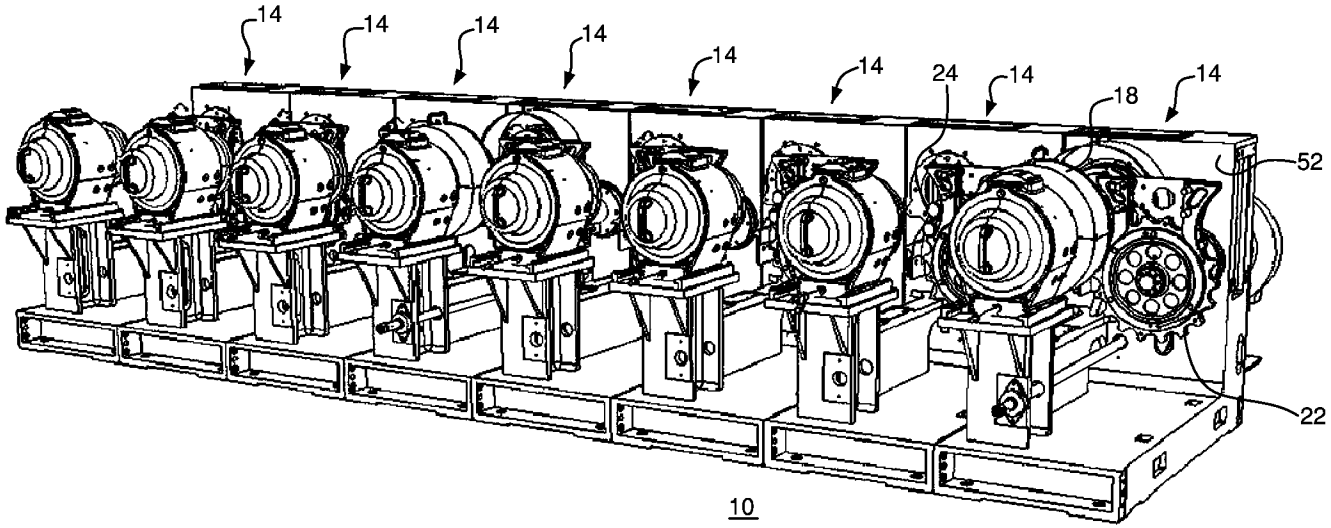
FIG. 1 is a perspective view depicting a multi-stage can necking machine.

As shown in FIG. 1, a multi-stage can necking machine 10 may include several necking stages 14. Each necking stage 14 includes a necking station 18 and a transfer starwheel 22. Each one of the necking stations 18 is adapted to incrementally reduce the diameter of an open end of a can body, and the transfer starwheels 22 are adapted to transfer the can body between adjacent necking stations 18, and optionally at the inlet and outlet of necking machine 10. Conventional multi-stage can necking machines, in general, include an input station and a waxer station at an inlet of the necking stages, and optionally include a bottom reforming station, a flanging station, and a light testing station positioned at an outlet of the necking stages. Accordingly, multi-stage can necking machine 10, may include in addition to necking stages 14, other operation stages such as an input station, a bottom reforming station, a flanging station, and a light testing station as in conventional multi-stage can necking machines (not shown). The term "operation stage" or "operation station" and its derivatives is used herein to encompass the necking station 14, bottom reforming station, a flanging station, and a light testing station, and the like.

Figure 2:
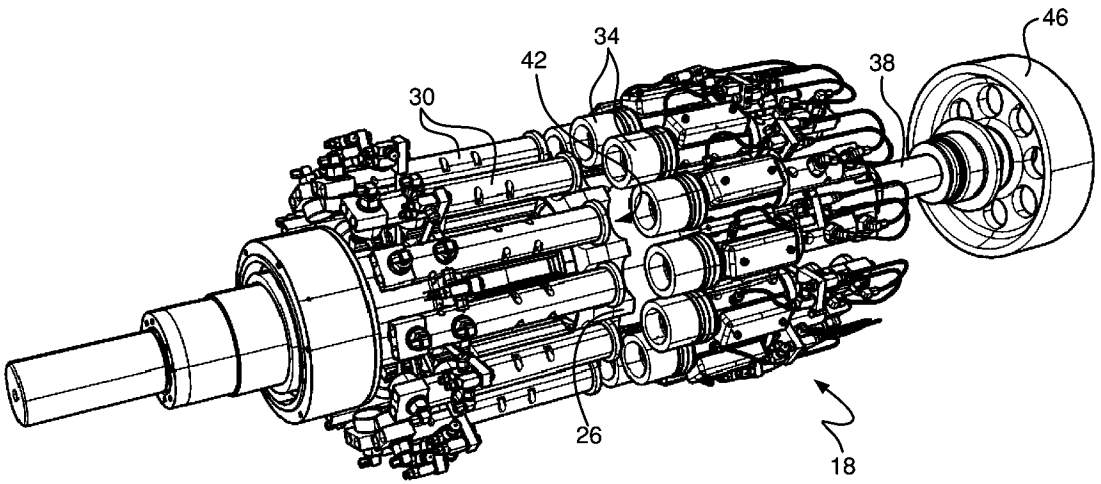
FIG. 2 is a perspective view depicting a necking station and gear mounted on a main turret shaft of the multi-stage necking machine shown in FIG. 1, with surrounding and supporting parts removed for clarity.

FIG. 2 is a detailed view depicting operative parts of one of the necking stations 18. As shown, each necking station 18 includes a main turret 26, a set of pusher rams 30, and a set of dies 34. The main turret 26, the pusher rams 30, and the dies 34 are each mounted on a main turret shaft 38. As shown, the main turret 26 has a plurality of pockets 42 formed therein. Each pocket 42 has a pusher ram 30 on one side of the pocket 42 and a corresponding die 34 on the other side of the pocket 42. In operation, each pocket 42 is adapted to receive a can body and securely holds the can body in place by mechanical means, such as by the action pusher ram and the punch and die assembly, and compressed air, as is understood in the art. During the necking operation, the open end of the can body is brought into contact with the die 34 by the pusher ram 30 as the pocket on main turret 26 carries the can body through an arc along a top portion of the necking station 18.

Die 34, in transverse cross section, is typically designed to have a lower cylindrical surface with a dimension capable of receiving the can body, a curved transition zone, and a reduced diameter upper cylindrical surface above the transition zone. During the necking operation, the can body is moved up into die 34 such that the open end of the can body is placed into touching contact with the transition zone of die 34. As the can body is moved further upward into die 34, the upper region of the can body is forced past the transition zone into a snug position between the inner reduced diameter surface of die 34 and a form control member or sleeve located at the lower portion of pusher ram 30. The diameter of the upper region of the can is thereby given a reduced dimension by die 34. A curvature is formed in the can wall corresponding to the surface configuration of the transition zone of die 34. The can is then ejected out of die 34 and transferred to an adjacent transfer starwheel.

As best shown in FIG. 2, a main turret gear 46 (shown schematically in FIG. 2 without teeth) is mounted proximate to an end of shaft 38. The gear 46 may be made of suitable material, and preferably is steel.

Also shown in FIG. 2, a plate 50 may be mounted near the end of shaft 38 but on the to the gear 46. The plate 50 may help ensure that the shaft 38 does not move within a support. FIG. 1 depicts each shaft 38 mounted in a respective support 52.

Figure 3:
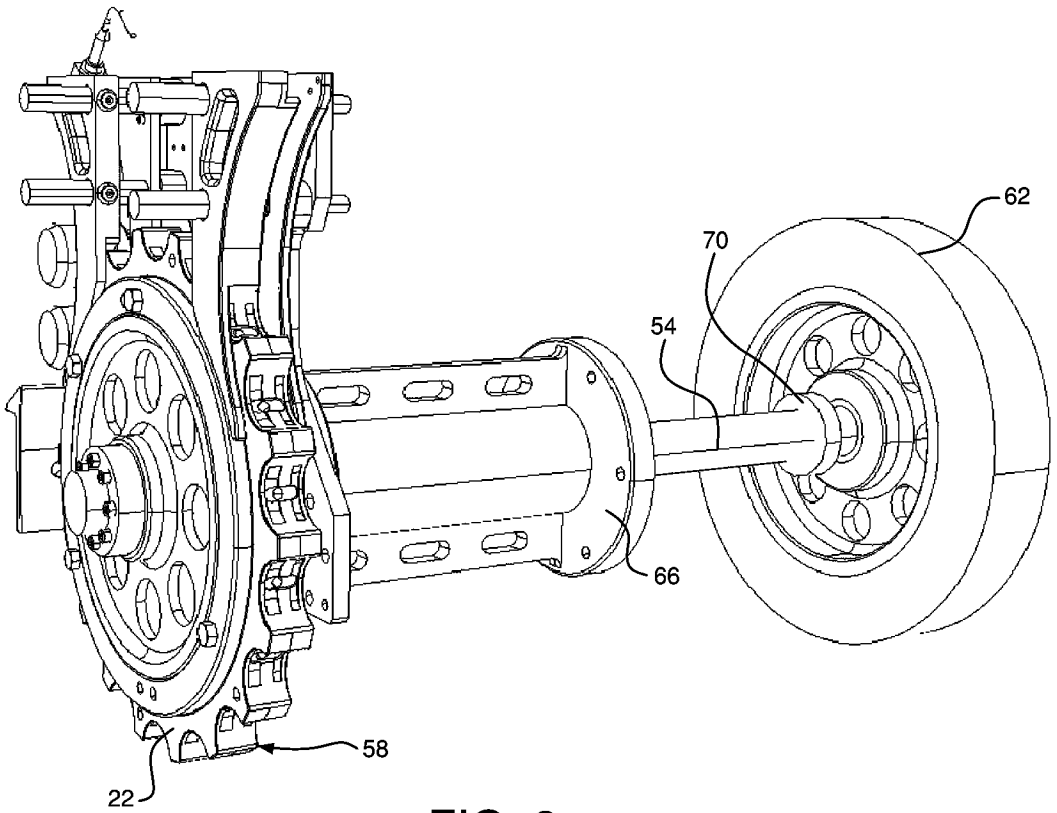
FIG. 3 is a perspective view depicting a transfer starwheel and gear mounted on a starwheel shaft of the multi-stage necking machine shown in FIG. 1, with surrounding and supporting parts removed for clarity.

As shown in FIG. 3, each starwheel 22 may be mounted on a shaft 54, and may include several pockets 58 formed therein. The starwheels 22 may have any amount of pockets 58. For example each starwheel 22 may include twelve pockets 58 or even eighteen pockets 58, depending on the particular application and goals of the machine design. Each pocket 58 is adapted to receive a can body and retains the can body using a vacuum force. The vacuum force should be strong enough to retain the can body as the starwheel 22 carries the can body through an arc along a bottom of the starwheel 22.

As shown, a gear 62 (shown schematically in FIG. 3 without teeth) is mounted proximate to an end of the shaft 54. Gear 62 may be made of steel but preferably is made of a composite material. For example, each gear 62 may be made of any conventional material, such as a reinforced plastic, such as Nylon 12.

As also shown in FIG. 3, a horizontal structural support 66 supports transfer shaft 54. Support 66 includes a flange at the rear end (that is, to the right of FIG. 3) for bolting to an upright support of the base of machine 10 and includes a bearing (not shown in FIG. 3) near the front end inboard of the transfer starwheel 22. Accordingly, transfer starwheel shaft 54 is supported by a rear end bearing that preferably is bolted to upright support 52 and a front end bearing that is supported by horizontal support 66, which itself is cantilevered from upright support 52. Preferably the base and upright support 52 is a unitary structure for each operation stage.

Figure 4:
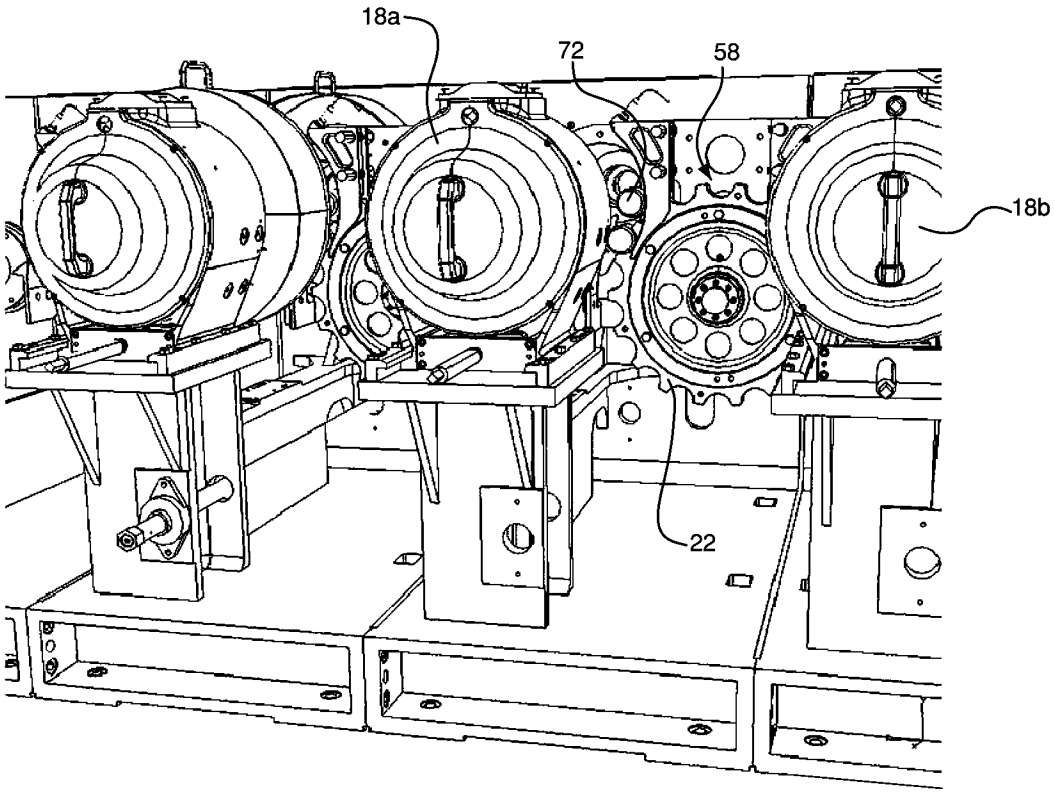
FIG. 4 is a partial expanded view depicting a section of the multi-stage can necking machine shown in FIG. 1.

FIG. 4 illustrates a can body 72 exiting a necking stage and about to transfer to a transfer starwheel 22. After the diameter of the end of a can body 72 has been reduced by the first necking station 18*a* shown in the middle of FIG. 4, main turret 26 of the necking station 18*a* deposits the can body into a pocket 58 of the transfer starwheel 22. The pocket 58 then retains the can body 72 using a vacuum force that is induced into pocket 58 from the vacuum system described in co-pending U.S. patent application Ser. No. 12/108,950, which is incorporated herein by reference in its entirety, carries the can body 72 through an arc over the bottommost portion of starwheel 22, and deposits the can body 72 into one of the pockets 42 of the main turret 26 of an adjacent necking station 18*b*. The necking station 18*b* further reduces the diameter of the end of the can body 72 in a manner substantially identical to that noted above.

Machine 10 may be configured with any number of necking stations 18, depending on the original and final neck diameters, material and thickness of can 72, and like parameters, as understood by persons familiar with can necking technology. For example, multi-stage can necking machine 10 illustrated in the figures includes eight stages 14, and each stage incrementally reduces the diameter of the open end of the can body 72 as described above.

Figure 5:
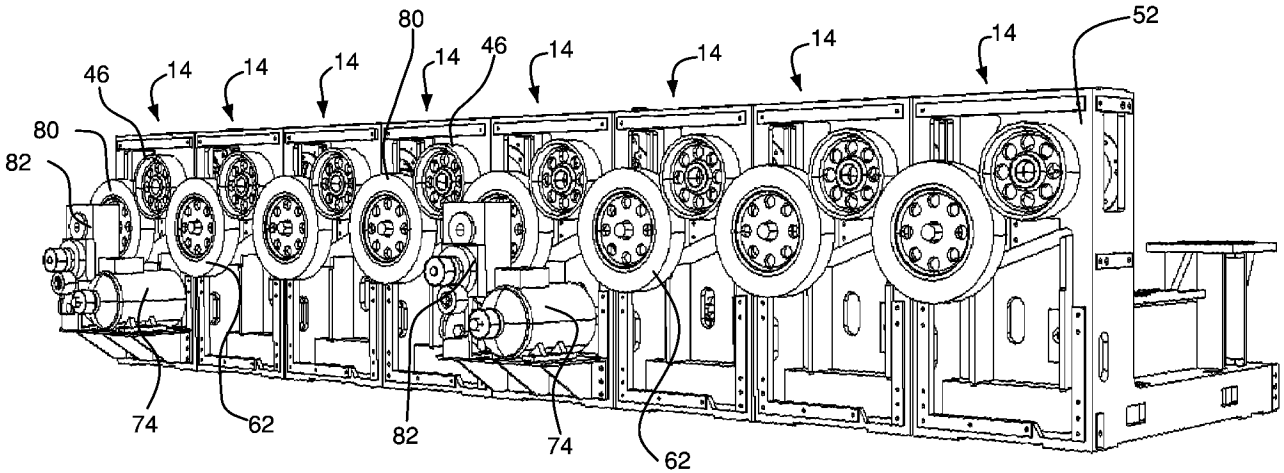
FIG. 5 is a perspective view depicting a back side of a multi-stage can necking machine having distributed drives.

As shown in FIG. 5, when the shafts 38 and 54 are supported near their rear ends by upright support 52, and the ends of the shafts 38 and 54 preferably are cantilevered such that the gears 46 and 62 are exterior to the supports 52. The gears 46 and 62 may have different diameters such that gear 46 may have a larger diameter than gear 62. A cover (not shown) for preventing accidental personnel contact with gears 46 and 62, may be located over gears 46 and 62. As shown, the gears 46 and 62 are in mesh communication to form a continuous gear train. The gears 46 and 62 preferably are positioned relative to each other to define a zig-zag or saw tooth configuration. That is, the main gears 46 are engaged with the transfer starwheel gears 62 such that lines through the main gear 46 center and the centers of opposing transfer starwheel gears 62 form an included angle of less than 170 degrees, preferably approximately 120 degrees, thereby increasing the angular range available for necking the can body. In this regard, because the transfer starwheels 22 have centerlines below the centerlines of main turrets 26, the operative portion of the main turret 26 (that is, the arc through which the can passes during which the necking or other operation can be performed) is greater than 180 degrees on the main turret 26, which for a given rotational speed provides the can with greater time in the operative zone. Accordingly the operative zone has an angle (defined by the orientation of the centers of shafts 38 and 54) greater than about 225 degrees, and even more preferably, the angle is greater than 240 degrees, as described in co-pending U.S. patent application Ser. No. 12/109,176. In general, the greater the angle that defines the operative zone, the greater the angular range available for necking the can body.

As shown in FIG. 5, the multi-stage can necking machine 10 may include several motors 74 to drive the gears 46 and 62 of each necking stage 14. As shown, there preferably is one motor 74 per every four necking stages 14. Each motor 74 is coupled to and drives a first gear 80 by way of a gear box 82. The motor driven gears 80 then drive the remaining gears of the gear train. By using multiple motors 74, the torque required to drive the entire gear train can be distributed throughout the gears, as opposed to prior art necking machines that use a single motor to drive the entire gear train. In the prior art gear train that is driven by a single gear, the gear teeth must be sized according to the maximum stress. Because the gears closest to the prior art drive gearbox must transmit torque to the entire gear train (or where the single drive is located near the center on the stages, must transmit torque to about half the gear train), the maximum load on prior art gear teeth is higher than the maximum tooth load of the distributed gearboxes according to the present invention. The importance in this difference in tooth loads is amplified upon considering that the maximum loads often occur in emergency stop situations. A benefit of the lower load or torque transmission of gears 46 and 62 compared with that of the prior art is that the gears can be more readily and economically formed of a reinforced thermoplastic or composite, as described above. Lubrication of the synthetic gears can be achieved with heavy grease or like synthetic viscous lubricant, as will be understood by persons familiar with lubrication of gears of necking or other machines, even when every other gear is steel as in the presently illustrated embodiment. Accordingly, the gears are not required to be enclosed in an oil-tight chamber or operate in an oil bath, but rather merely require a minimal protection against accidental personnel contact Each motor 74 is driven by a separate inverter which supplies the motors 74 with current. To achieve a desired motor speed, the frequency of the inverter output is altered, typically between zero to 50 (or 60 hertz). For example, if the motors 74 are to be driven at half speed (that is, half the rotational speed corresponding to half the maximum or rated throughput) they would be supplied with 25 Hz (or 30 Hz).

Figure 6:
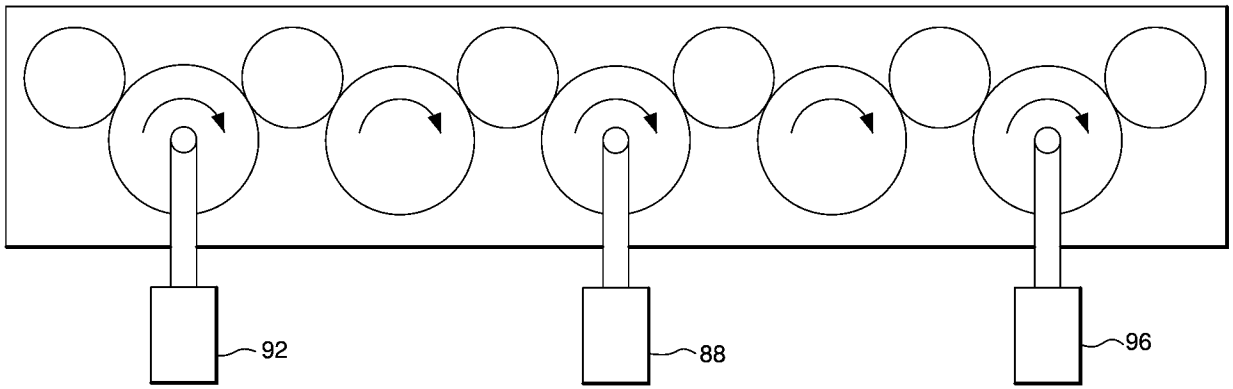
FIG. 6 is a schematic illustrating a machine having distributed drives.

In the case of the distributed drive configuration shown herein, each motor inverter is set at a different frequency. Referring to FIG. 6 for example, a second motor 88 may have a frequency that is approximately 0.02 Hz greater than the frequency of a first motor 92, and a third motor 96 may have a frequency that is approximately 0.02 Hz greater than the frequency of the second motor 88. It should be understood that the increment of 0.02 Hz may be variable, however, it will be by a small percentage (in this case less than 1%).

Figure 7:
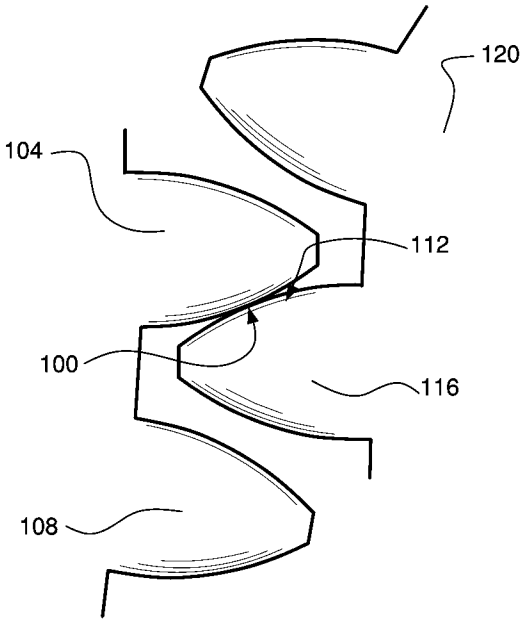
FIG. 7 is a partial expanded view depicting gear teeth from adjacent gears engaging each other.

The downstream motors preferably are preferably controlled to operate at a slightly higher speed to maintain contact between the driving gear teeth and the driven gear teeth throughout the gear train. Even a small freewheeling effect in which a driven gear loses contact with its driving gear could introduce a variation in rotational speed in the gear or misalignment as the gear during operation would not be in its designed position during its rotation. Because the operating turrets are attached to the gear train, variations in rotational speed could produce misalignment as a can 72 is passed between starwheel pockets and variability in the necking process. The actual result of controlling the downstream gears to operate a slightly higher speed is that the motors 88, 92, and 96 all run at the same speed, with motors 88 and 96 "slipping," which should not have any detrimental effect on the life of the motors. Essentially, motors 88 and 96 are applying more torque, which causes the gear train to be "pulled along" from the direction of motor 96. Such an arrangement eliminates variation in backlash in the gears, as they are always contacting on the same side of the tooth, as shown in FIG. 7. As shown in FIG. 7, a contact surface 100 of a gear tooth 104 of a first gear 108 may contact a contact surface 112 of a gear tooth 116 of a second gear 120. This is also true when the machine starts to slow down, as the speed reduction is applied in the same way (with motor 96 still being supplied with a higher frequency). Thus "chattering" between the gears when the machine speed changes may be avoided.

In the case of a machine using one motor, reductions in speed may cause the gears to drive on the opposite side of the teeth. It is possible that this may create small changes in the relationship between the timing of the pockets passing cans from one turret to the next, and if this happens, the can bodies may be dented.

The present invention is illustrated herein. The present invention is not limited to the particular structure disclosed herein, but rather encompasses straightforward variations thereof as will be understood by persons familiar with can necking machine technology. The invention is entitled to the full scope of the claims.

What is claimed:

1. A multi-stage can necking machine assembly having distributed drives, comprising:

plural operation stages, at least some of the operation stages configured for can necking operations, each operation stage comprising a main turret shaft, a transfer starwheel shaft, and a support for mounting the main turret shaft and transfer starwheel shaft;

each main turret shaft and transfer starwheel shaft having a gear, the gears of the operation stages being in meshed communication to form a continuous gear train; and at least a first motor, a second motor, and a third motor that are distributed among the operation stages and mechanically coupled to the gear train such that the second and third motors are downstream from the first motor, wherein the second and third motors apply greater torque to the gear train than the first motor so as to minimize variation in backlash in the gears.

2. The multi-stage can necking machine of claim 1, wherein the gears of the main turret shafts are made of a composite.

3. The multi-stage can necking machine of claim 1, wherein the gears of the transfer starwheel shafts are made of a composite.

4. The multi-stage can necking machine of claim 1, wherein the second motor has a fixed frequency that is greater than a fixed frequency of the first motor.

5. The multi-stage can necking machine of claim 1, wherein the plural of operation stages comprises a necking stage, a base reforming stage, and a flanging stage.

6. The multi-stage can necking machine of claim 1, wherein each motor is capable of driving all of the operation stages.

7. The multi-stage can necking machine of claim 1, wherein the shafts extend beyond a back surface of a respective support, such that the gears are exterior to the supports.

8. The multi-stage can necking machine of claim 4, wherein the third motor has a fixed frequency that is greater than a fixed frequency of the second motor, and the fixed frequency of the second motor is greater than a fixed frequency of the first motor.

9. The multi-stage can necking machine of claim 8, wherein the third motor has a fixed frequency that is approximately 0.02 Hz greater than a fixed frequency of the second motor, and the fixed frequency of the second motor is approximately 0.02 Hz greater than a fixed frequency of the first motor.

10. The multi-stage can necking machine of claim 8, wherein the second and third motors slip.

11. A multi-stage can necking machine comprising:

a first high speed operation stage configured for can necking operations, the first operation stage comprising, a first shaft, a second shaft, and a first support for mounting the first and second shafts;

a second high speed operation stage comprising, a first shaft, a second shaft, and a second support for mounting the first and second shafts, wherein (i) each shaft comprises a gear and the gears are in meshed communication to form a continuous gear train, and (ii) the gears of the first shafts are made of a composite material and are configured to operate without being disposed in an oil-tight chamber; and a first motor and a second motor that are mechanically coupled to the gear train such that the second motor is downstream from the first motor, the second motor is configured to operate at a higher speed than the first motor, so as to maintain contact between driving gear teeth and driven gear teeth.

12. The multi-stage can necking machine of claim 11, wherein the first shafts each support a transfer starwheel, and the second shafts each support a main turret.

13. The multi-stage can necking machine of claim 11, wherein the gears of the first shafts have a larger diameter than the gears of the second shafts.

14. The multi-stage can necking machine of claim 11, wherein the first and second shafts extend beyond a back surface of their respective supports such that the gears are exterior to the supports.

15. The multi-stage can necking machine of claim 11, wherein the composite material expands when the material is heated.

16. The multi-stage can necking machine of claim 11, wherein the first operation stage is adjacent to the second operation stage.

* * * * *